US009384639B2

(12) United States Patent
White

(10) Patent No.: US 9,384,639 B2
(45) Date of Patent: Jul. 5, 2016

(54) RIGID FIXTURE FOR COUPLING ONE OR MORE TRANSDUCERS TO THE UPPER BACK OF THE HUMAN BODY

(71) Applicant: Michael Joseph White, Brooklyn, NY (US)

(72) Inventor: Michael Joseph White, Brooklyn, NY (US)

( * ) Notice: Subject to any disclaimer, the term of this patent is extended or adjusted under 35 U.S.C. 154(b) by 0 days.

(21) Appl. No.: 13/934,909

(22) Filed: Jul. 3, 2013

(65) Prior Publication Data

US 2015/0013111 A1 Jan. 15, 2015

(51) Int. Cl.

| | |
|---|---|
| ***H04R 1/02*** | (2006.01) |
| ***G08B 6/00*** | (2006.01) |
| *H04R 9/06* | (2006.01) |
| *H04R 27/00* | (2006.01) |

(52) U.S. Cl.

CPC *G08B 6/00* (2013.01); *H04R 1/025* (2013.01); *H04R 1/021* (2013.01); *H04R 9/066* (2013.01); *H04R 27/00* (2013.01); *H04R 2201/023* (2013.01); *Y10T 24/13* (2015.01)

(58) Field of Classification Search

CPC ..... H04R 2201/023
USPC ..... 463/30; 381/151, 385, 386, 388; D14/204; 600/27

See application file for complete search history.

(56) References Cited

U.S. PATENT DOCUMENTS

| | | | | |
|---|---|---|---|---|
| 3,134,861 | A * | 5/1964 | Dempsey et al. | 381/326 |
| 4,070,553 | A | 1/1978 | Hass | |
| 4,322,585 | A | 3/1982 | Liautaud | |
| 4,485,276 | A | 11/1984 | Sato | |
| 4,641,345 | A | 2/1987 | Takahashi | |
| 4,764,962 | A * | 8/1988 | Ekman et al. | 381/301 |
| 4,798,539 | A * | 1/1989 | Henry et al. | 434/319 |
| 5,101,810 | A * | 4/1992 | Skille et al. | 601/47 |
| D355,751 | S | 2/1995 | Dagan | |
| 5,553,148 | A | 9/1996 | Werle | |
| 5,565,840 | A | 10/1996 | Glass et al. | |
| 5,669,818 | A | 9/1997 | Glass et al. | |
| 5,680,465 | A | 10/1997 | Boyden | |
| 5,687,244 | A | 11/1997 | Untersander | |
| 5,762,616 | A * | 6/1998 | Talish | 601/2 |

(Continued)

FOREIGN PATENT DOCUMENTS

| | | |
|---|---|---|
| EP | 0009116 A1 | 8/1979 |
| EP | 0746393 A1 | 9/1994 |

OTHER PUBLICATIONS

"BoneFone" advertisement, Modern Mechanix, Nov. 1980.

(Continued)

*Primary Examiner* — Justin Larson

(57) ABSTRACT

One embodiment of a rigid fixture for coupling one or more transducers to the center upper back of the human body. The left contact area (10) and right contact area (11) are curved surfaces designed to ergonomically fit against the trapezius muscle groups. The contact areas (10) and (11) may optionally be covered with a cushioning pads (31). Between the contact areas (10) and (11) is a center section spaced away from the spine (12) that is not in contact with the human body. One or more transducers (30) are attached or incorporated into the center section (12), which may be facilitated by transducer attach points (21). The entire fixture can be fastened to straps, belts, harnesses, backpacks, clothing, or seats by the attach points (20).

7 Claims, 4 Drawing Sheets

(56) References Cited

U.S. PATENT DOCUMENTS

| | | | | |
|---|---|---|---|---|
| 5,873,736 | A * | 2/1999 | Harrison | 434/322 |
| D411,576 | S | 6/1999 | Hames | |
| 5,988,469 | A * | 11/1999 | Musacchia | 224/267 |
| 6,004,209 | A | 12/1999 | Fujimoto et al. | |
| 6,192,137 | B1 * | 2/2001 | Heo | 381/386 |
| 6,275,213 | B1 | 8/2001 | Tremblay | |
| 6,488,190 | B1 * | 12/2002 | Alonzo | 224/576 |
| 6,494,719 | B1 * | 12/2002 | Logan | 434/262 |
| 6,718,044 | B1 * | 4/2004 | Alleyne | 381/336 |
| 6,782,113 | B1 * | 8/2004 | Handsaker | 381/386 |
| 6,902,463 | B2 * | 6/2005 | Vaicunas et al. | 446/397 |
| 7,331,871 | B2 | 2/2008 | Lopez | |
| 7,353,974 | B2 * | 4/2008 | Arndt, III | 224/222 |
| 7,440,581 | B2 | 10/2008 | Wiener | |
| 7,571,002 | B2 * | 8/2009 | Thrope et al. | 607/48 |
| 7,967,679 | B2 | 6/2011 | Ombrellaro | |
| 7,990,022 | B2 * | 8/2011 | Heim | 310/324 |
| 8,023,680 | B2 * | 9/2011 | Hayasaka et al. | 381/386 |
| 8,139,803 | B2 | 3/2012 | Afshar | |
| 8,740,825 | B2 * | 6/2014 | Ehrenreich et al. | 601/47 |
| 8,804,093 | B2 * | 8/2014 | Haight et al. | 352/3 |
| 8,811,636 | B2 * | 8/2014 | Stephanou et al. | 381/190 |
| 2001/0018311 | A1 * | 8/2001 | Musacchia | 446/418 |
| 2002/0049395 | A1 * | 4/2002 | Thompson et al. | 601/2 |
| 2004/0097850 | A1 * | 5/2004 | Plante | 601/41 |
| 2004/0153009 | A1 * | 8/2004 | Horzewski et al. | 601/2 |
| 2006/0227982 | A1 * | 10/2006 | Miranda | 381/151 |
| 2006/0258962 | A1 * | 11/2006 | Kopanic et al. | 601/15 |
| 2007/0160238 | A1 * | 7/2007 | Kobayashi | 381/151 |
| 2007/0200467 | A1 * | 8/2007 | Heydt et al. | 310/800 |
| 2008/0153590 | A1 * | 6/2008 | Ombrellaro et al. | 463/30 |
| 2008/0208084 | A1 * | 8/2008 | Horzewski et al. | 601/2 |
| 2008/0219468 | A1 * | 9/2008 | Williams et al. | 381/77 |
| 2008/0298627 | A1 * | 12/2008 | Bonebright et al. | 381/386 |
| 2009/0076421 | A1 * | 3/2009 | Grant, Jr. | 601/47 |
| 2011/0044486 | A1 * | 2/2011 | Borkowski | 381/333 |
| 2013/0123570 | A1 * | 5/2013 | Ly et al. | 600/27 |
| 2013/0200117 | A1 * | 8/2013 | Monro et al. | 224/183 |
| 2014/0309483 | A1 * | 10/2014 | Levendowski et al. | 600/27 |
| 2014/0330070 | A1 * | 11/2014 | Anabalon Alamos et al. | 600/27 |
| 2015/0013111 | A1 * | 1/2015 | White | 24/3.1 |

OTHER PUBLICATIONS

Doug Horton, "Avism Hardware Review: Aura Interactor", www.avism.com, www.avism.com/pages/0604/aura/aura_interactor.htm, 2004.

* cited by examiner

RIGID FIXTURE FOR COUPLING ONE OR MORE TRANSDUCERS TO THE UPPER BACK OF THE HUMAN BODY

CROSS-REFERENCE TO RELATED APPLICATIONS

This application claims the benefit of the provisional patent Application No. 61/668,370 filed Jul. 5, 2012 by the present inventor.

BACKGROUND

Prior Art

The following is a tabulation of some prior art that presently appears relevant:

U.S. Patents

| Patent Nr. | Kind | Filing Date | Inventor | Title |
|---|---|---|---|---|
| 7967679 | B2 | Dec. 7, 2007 | Mark P. Ombrellaro, Baltazar Soto, Jr., Aaron Leonard Morris, Joshua John Kelly, Patrick A. Ombrellaro | Tactile wearable gaming device |
| 8139803 | B2 | May 12, 2006 | Shahriar S. Afshar | Systems and methods for haptic sound |
| 7440581 | B2 | Apr. 24, 2006 | David Wiener | Backpack with integrated speakers |
| 7331871 | B2 | May 5, 2004 | Miguel Lopez | Tactile signal-producing vest worn while playing a video game |
| 6275213 | B1 | May 1, 2000 | Mark R. Tremblay, Mark H. Yim | Tactile feedback man-machine interface device |
| D411576 | S | Jun. 29, 1998 | Edward L. Hames | Vest for use with a video game system |
| 5687244 | A | Mar. 28, 1996 | Peter Untersander | Bone conduction speaker and mounting system |
| 6004209 | A | May 29, 1995 | Keiji Fujimoto, Akira Fujiwara, Tokurou Fujiwara, Atsushi Katsumoto, Masahiko Kurokawa, Koji Miura, Kazuyuki Seri, Nobuo Takenouchi | Body-acoustic device, playing apparatus and its control method, light-beam utilizing playing apparatus, and acoustic apparatus |
| 5680465 | A | Apr. 5,1995 | James H. Boyden | Headband audio system with acoustically transparent material |
| 5669818 | A | Mar. 23, 1995 | Thomas K. Glass, Craig Thorner | Seat-based tactile sensation generator |
| 5565840 | A | Sep. 21, 1994 | Thomas K. Glass, Craig Thorner | Tactile sensation generator |
| 5553148 | A | Jun. 20, 1994 | Ben Werle | Apparatus and method for producing vibratory sensations to accompany audible sounds in a properly phased relationship |
| D355751 | S | Jan. 6, 1994 | Gideon Dagan | Video game accessory vest |
| 4641345 | A | Dec. 28, 1984 | Yoshio Takahashi | Body-sensible acoustic device |
| 4485276 | A | Aug. 3, 1983 | Masaaki Sato | Personal audio device |
| 4322585 | A | May 5, 1980 | James P. Liautaud | Personal electronic listening system with an air and bone transducer mounted on the clothing collar |
| 4070553 | A | Feb. 10, 1977 | William J. Hass | Personal audio listening system |

U.S. Patent Application Publications

| Publ. Nr. | Kind | Filing Date | Applicant | Title |
|---|---|---|---|---|
| EP 0746393 | A1 | Sep. 14, 1994 | Lawrence Shultz, David Tung, Richard Vincent | Dual output multi function interface device for audio systems |
| EP 0009116 | A1 | Aug. 13, 1979 | Rene Dr. Pomeranz | Device and method for the electroacoustic reproduction of sound by earphones, as well as a device for transmitting sound vibrations to the human body |

Many naturally occurring sounds are often very loud and of a low frequency, thunder claps being an example. Such sounds are often felt in the whole human body as much as they are heard. This visceral feeling is just as an important a component of the experience as is the actual heard sound. Further, large PA systems and large sound systems, at night clubs and at concert venues, often feature music or other content with loud and low frequency sounds. Again, much of this content is felt by the human body just as much as it is heard. However, most small sound reproduction systems that are portable or carry-able by a single person cannot create an experience that can be felt in the body—its just too impractical to incorporate large high powered speakers into such devices.

A solution to this problem is the use of tactile transducers instead of large speakers. The tactile transducer does not create sound but rather creates vibration that is transmitted directly to the listener—either by being mounted to furniture—or by being mounted directly to the human body in some fashion. Thus small portable audio devices can recreate this desired visceral overall body experience in a small portable package.

Several devices for coupling transducers to the human body have been proposed—yet all mounting methods heretofore known suffer from a number of disadvantages:

(a) They mount the transducer to the front of the human body, often the chest. This makes it difficult for the device to fit varying body types and body types of differing genders. These designs are not unisex. (U.S. Pat. Nos. 8,139,803, 5,687,244, D355751, 4,070,553. Also EP 0009116)

(b) They are mounted directly on bones or areas of the body with significant cartilage such as the spine or sternum (U.S. Pat. Nos. 6,275,213, 5,687,244, 4,070,553). Vibration related health concerns are most severe when vibration is applied to bone and cartilage areas of the body and should be avoided.

(c) They do not allow for adequate airflow to cool transducers—often placing transducers inside of fabric pockets or fully enclosing them in enclosures with little or no airflow or venting. (U.S. Pat. Nos. 8,139,803, 7,440,581, 7,331,871, 6,275,213, 5,687,244, 6,004,209)

(d) When mounted on the human back, they are mounted on the lower back. This interferes with sitting in any chair while wearing the device. (U.S. Pat. Nos. 6,004,209, D355751)

(e) They place transducers directly against the human body. Since most transducers are not ergonomically shaped—this is uncomfortable for the wearer. (U.S. Pat. Nos. 7,440,581, 7,331,871, 6,275,213)

(f) They do not have mounting points for harnesses on the transducers—thus having to place transducers in pockets of a harness or garment. Since transducers shake when creating vibration, any slack in the pockets or harness is undesirable. Further some designs do not use harnesses at all, using gravity to hold the transducer to the human body. Unless the transducer is firmly attached to the human body, much of the vibration is wasted as inefficient shaking (U.S. Pat. Nos. 7,440,581, 7,331,871, 4,322,585, 4,070,553)

(g) They must use multiple transducers to transmit vibration symmetrically to more than one place on the human body. (U.S. Pat. Nos. 7,967,679, 8,139,803, 7,440,581, 7,331,871, 6,275,213)

SUMMARY

In accordance with one embodiment comprises a rigid fixture for coupling one or more tactile transducers to the upper back of the human body on or near the trapezius muscle groups. The fixture may be made of plastic, metal, composites, wood, or other rigid material and may optionally include cushioning pads where contacting the body made of silicone, foam, or other material. The fixture is ergonomically designed to be centered on the upper back where the left and right side are in direct contact with the body, and the center of the structure is spaced away from the spinal area of the body. One or more tactile transducers are mounted in this center section.

Advantages

Accordingly several advantages of one or more aspects are as follows: to allow the fixture to be ergonomically and comfortably fit to a wide variety of body types regardless of gender (the design is unisex) and regardless of the specific transducer used, to transmit the transducer created vibration symmetrically to the trapezius muscle groups but not to the spine directly even when one transducer is used, to allow the transducer to have passive convection ventilation to dissipate heat, to serve as an attachment surface for harnesses, clothing, or backpacks to which the device is incorporated, to allow comfortable sitting on low back chairs when worn with a harness, and to serve as a body contact point when built into seats or other fixed objects.

DRAWINGS

Figures

Figure 6A:
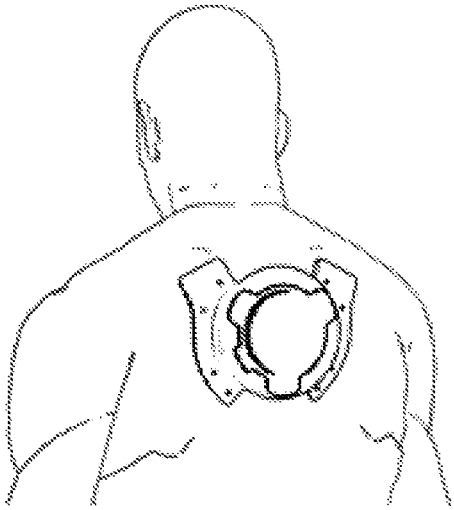
Figure 6B:
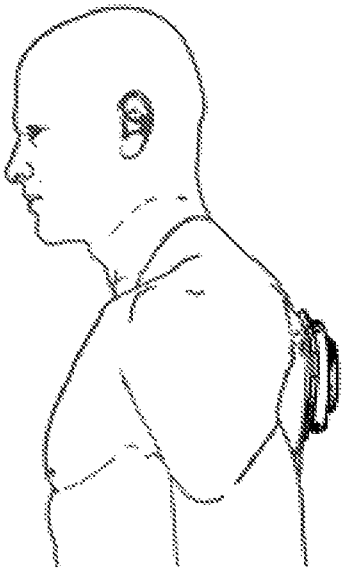
Figure 6C:
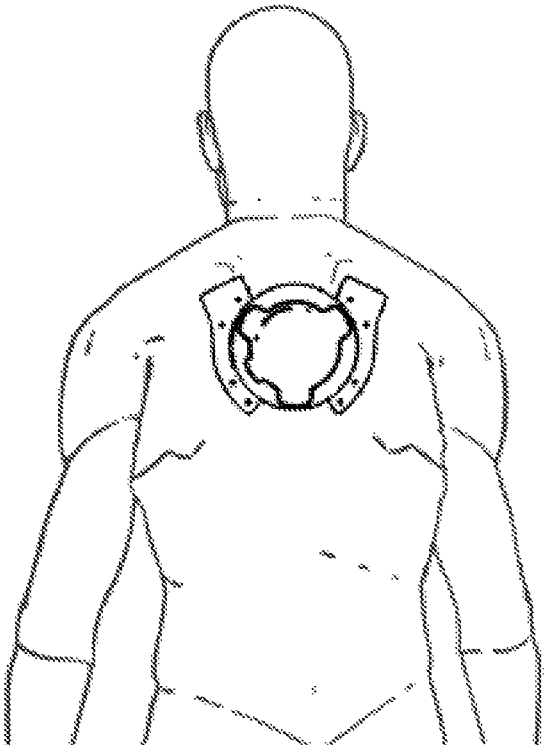

FIGS. 6A, 6B, and 6C show where the fixture is placed on the human body.

| Drawings-Reference Numerals | |
|---|---|
| 10 | left side contact area |
| 11 | right side contact area |
| 12 | center section spaced away from the spine |
| 20 | attach points for harness, clothing, backpacks, or mounting in seating or other fixed objects |
| 21 | attach points to mount one or more transducers |
| 30 | a tactile transducer |
| 31 | cushioning pad |

DETAILED DESCRIPTION

FIGS. 1A, 1B, 2A, 2B, 3A, 3B, 6A, 6B, 6C

Figure 1A:
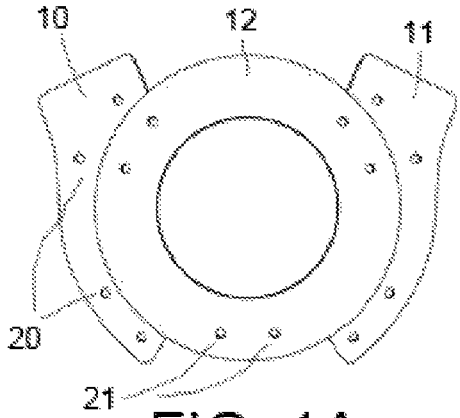
FIG. 1A shows various aspects of a rigid fixture from a top view—the area facing away from the human body.
Figure 1B:
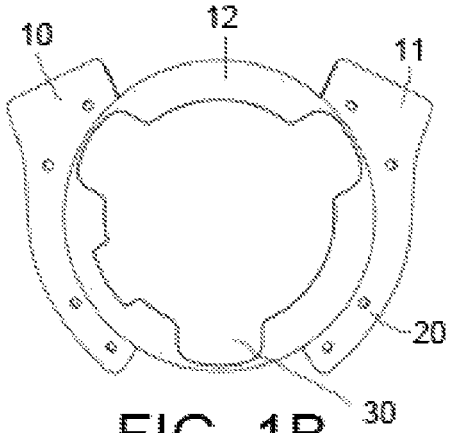
FIG. 1B shows the same fixture as FIG. 1A but also includes the outline of an attached transducer.
Figure 2A:
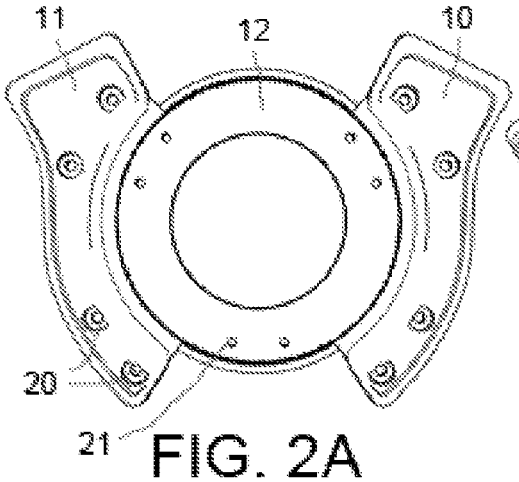
FIG. 2A shows the same rigid fixture from a bottom view—the area facing toward the human body.
Figure 2B:
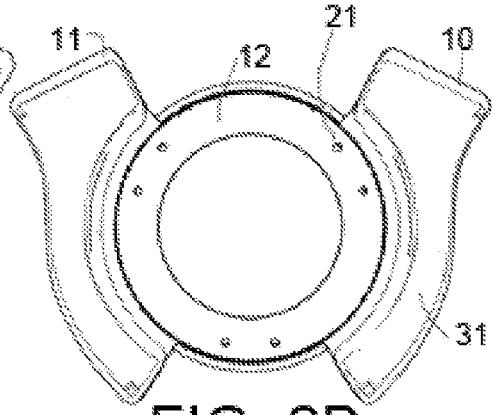
FIG. 2B shows the same fixture as FIG. 2A but also includes an attached transducer and optional cushioning pads.
Figure 3A:
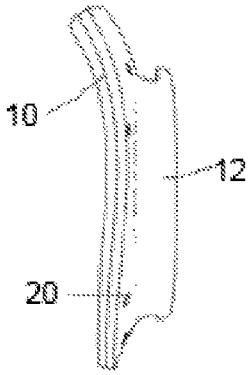
FIG. 3A shows the same rigid fixture from a side view.
Figure 3B:
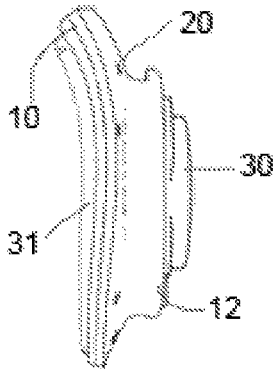
FIG. 3B shows the same fixture as FIG. 3A but also includes an attached transducer and optional cushioning pads.
Figure 4A:
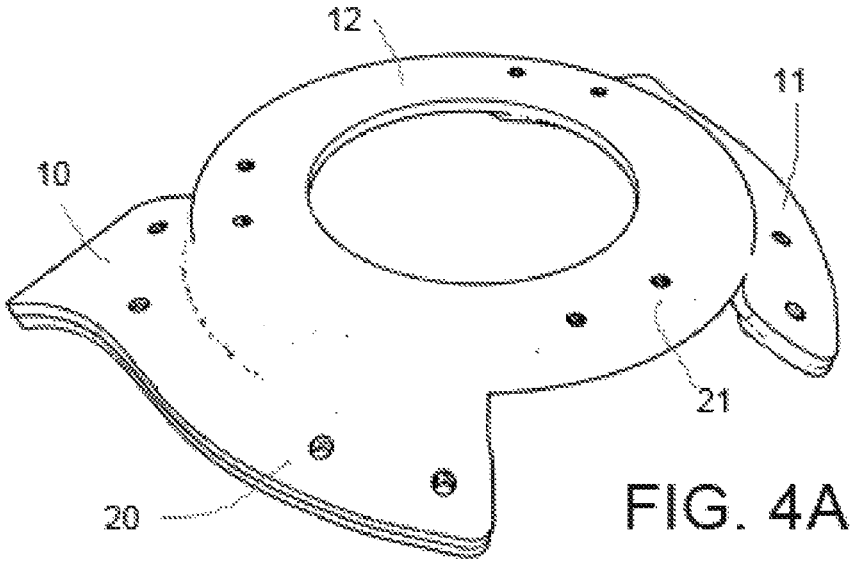
FIG. 4A shows the same rigid fixture from a top perspective view.
Figure 4B:
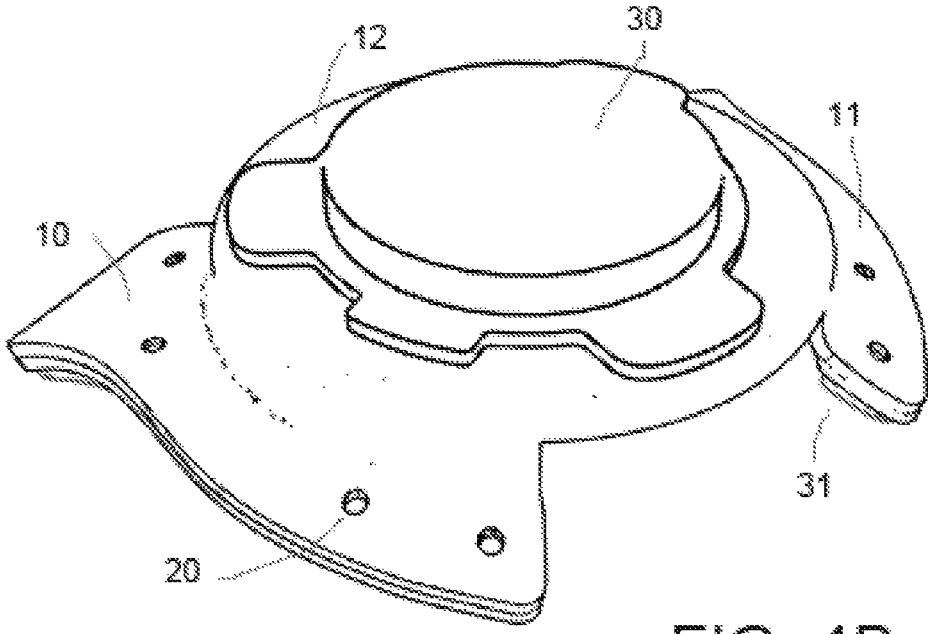
FIG. 4B show the same fixture as FIG. 4A but with an attached transducer and optional cushioning pads.
Figure 5A:
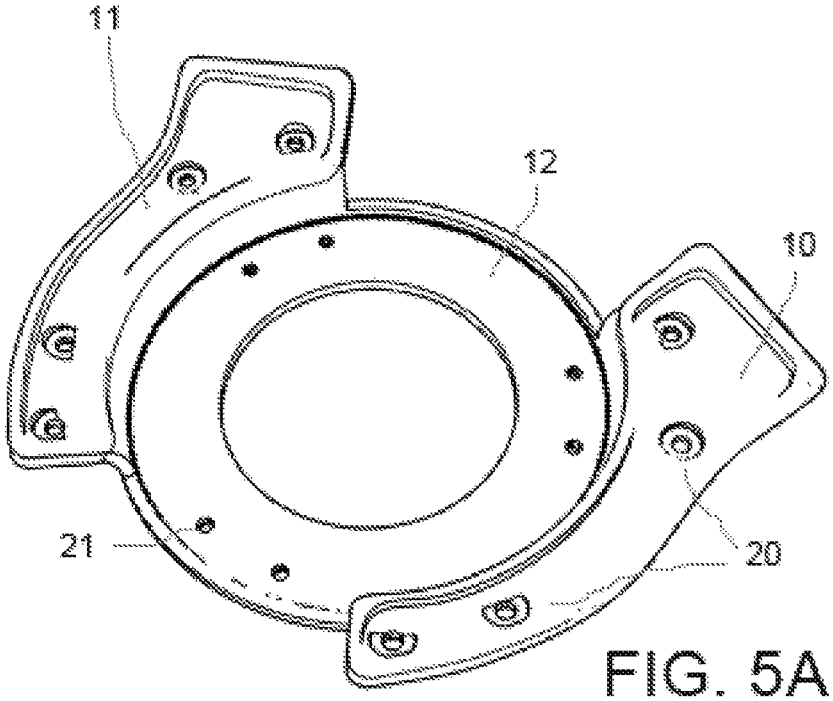
FIG. 5A shows the same rigid fixture from a bottom perspective view.
Figure 5B:
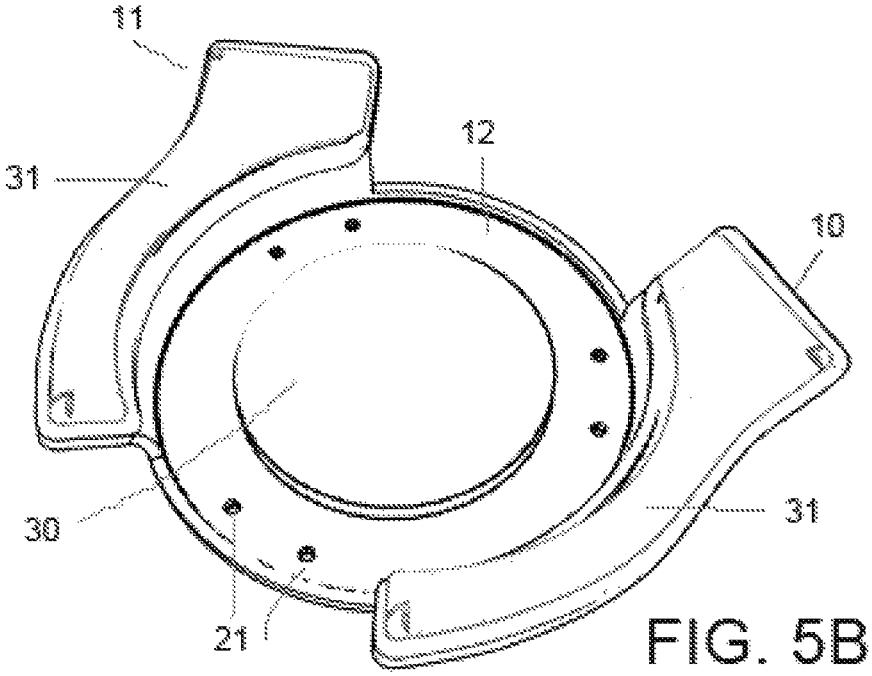
FIG. 5B shows the same fixture as FIG. 5A but also includes an attached transducer and optional cushioning pads.

One embodiment of the fixture is illustrated in FIG. 1A (top view), FIG. 2A (bottom view), and FIG. 3A (side view). The fixture may be made of plastic, metal, composites, wood, or other rigid material. The fixture is centered on the upper back of the human body (FIGS. 6A-6C). The left contact area 10 and right contact area 11 are curved surfaces designed to ergonomically fit against the trapezius muscle groups. The contact areas 10 and 11 may optionally be covered with a cushioning pads 31 made of silicone, foam, gel, or other material. Between the contact areas 10 and 11 is a center section spaced away from the spine 12 that is not in contact with the body. One or more transducers 30 are attached or incorporated into the center section 12, which may be facilitated by transducer attach points 21. The entire fixture can be fastened to straps, belts, harnesses, backpacks, clothing, or seats by the attach points 20.

Operation—FIGS. 1B, 2B, 3B, 6A, 6B, 6C

The manner of using the fixture is to attach a transducer 30 to the attach points 21 and to attach a harness (straps, belts) to attach points 20. The fixture is then fixed in place on the upper back of the human body (FIGS. 6A, 6B, 6C) where left contact area 10 is in contact with left trapezius muscle group and the right contact area 11 is in contact with the right trapezius muscle group and the center section is spaced away from the spine 12. The fixture transmits the vibration from the transducer 30 to the left contact area 10 and the right contact area 11 which in turn transmits said vibration to the upper back of the human body.

Advantages

From the description above, a number of advantages of some embodiments of my fixture become evident:

(a) The fixture can be ergonomically shaped to comfortably fit the human body and to allow any type of transducer to be attached to it. This allows any transducer regardless of its shape to be used in an ergonomic and comfortable manner.

(b) The shape of upper back of the human body varies much less than other parts of the body between individuals of various sizes, weights, heights, ages, and genders. In contrast, chests and abdomens vary greatly in shape between individuals of various sizes, weights, heights, ages, and genders. Because the fixture is designed to fit the upper back of the human body, the same fixture can comfortably be worn by a wide range of body types.

(c) The fixture allows a single vibration source to be applied symmetrically to both sides of the body.

(d) Because the center section 12 is spaced away from the spine, the fixture is only in contact with large muscle groups and is not in contact with any bones or high cartilage areas of the body. There are potential health concerns when vibration is applied directly to bones or cartilage and should be avoided.

(e) Because the center section 12 is spaced away from the body, the resulting air gap ventilates the attached transducer facilitating passive convection air cooling from both the top and the bottom of said transducer. This is also more comfortable because an overly warm transducer does not directly contact the human body.

(f) The fixture serves as an attachment point when built into harnesses, clothing, backpacks, or other wearable objects.

(g) The fixture serves as a contact point when built into seats or other fixed objects.

(h) Because the fixture is placed on the upper back, it does not obstruct sitting in low back chairs, such as chairs and benches on municipal buses and subways.

CONCLUSIONS, RAMIFICATIONS, AND SCOPE

Accordingly the reader will see that the rigid fixture ergonomically couples transducer created vibration to the human body facilitating visceral overall body sensations of audio or other content, in a small portable package. The fixture design is inherently unisex and allows various transducers to be used regardless of their shape. The fixture transmits vibration symmetrically to both sides of the body even when one transducer is used. The fixture is in contact with large muscle groups rather than the spine or other high cartilage areas. The fixture allows the transducer to be fully ventilated. The fixture serves as an attachment point for harnesses, straps, backpacks, or clothing. The fixture serves as contact point when incorporated into seats or other fixed objects. And the fixture can comfortably be worn when sitting in low back chairs.

Although the description above contains many specificities, these should not be construed as limiting the scope of the embodiments but as merely providing illustrations of some of several embodiments. For example, the fixture can have other shapes, such a rectangular or triangular etc. The center area could be shaped to accommodate various types of transducers, etc.

Thus the scope of the embodiments should be determined by the appended claims and their legal equivalents, rather than the examples given.

I claim:

1. A fixture for mounting one or more tactile transducers to transmit vibration to the upper back of the human body comprising: a right side curved surface ergonomically shaped to be in contact with the right side of the human upper back; a left side curved surfaced ergonomically shaped to be in contact with the left side of the human upper back; a center surface not in direct contact with the human body and away from the spine, connecting said right side curved surface and said left side curved surface; attach points or openings on said center surface for mounting one or more tactile transducers; and attach points on said right side curved surface and said left side curved surface to attach belts, straps, harnesses, clothing, backpacks or other wearable objects, or to mount to a seat or other furniture.

2. The fixture of claim 1, wherein said fixture is composed of a material such as plastic, metal, wood, composite, or ceramic, said material having the property of transmitting vibration.

3. The fixture of claim 1, wherein said fixture further includes padding between the left and right side surfaces and the contact points on the upper back of the human body, wherein this padding can be made of silicone, foam, rubber, or other material.

4. The fixture of claim 1, wherein said center surface attach points for mounting one or more tactile transducers are made of material that transmits vibration rather than dampening and absorbing vibration.

5. The fixture of claim 1, wherein said center surface is spaced 1/16th inch or more away from the human body, making a vertical air gap that facilitates passive convection air cooling of the tactile transducer(s).

6. The fixture of claim 1, wherein said center surface is spaced 1/16th inch or more away from the human body, avoiding sending vibration directly into the spine.

7. The fixture of claim 1, wherein the left side curved surface and right side curved surface are in contact with the trapezius muscle groups and said center surface is spaced away from the human body and not in contact with the spine.

* * * * *